US006003797A

United States Patent [19]

Lin

[11] Patent Number: 6,003,797

[45] Date of Patent: Dec. 21, 1999

[54] MEAT MINCER COMBINATION HAVING A MINCER DEVICE REPLACEABLE STRUCTURE

[76] Inventor: David Lin, No. 8, Ta-Kuang St., Feng Yuan City, Taichung Hsien, Taiwan

[21] Appl. No.: 09/169,810

[22] Filed: Oct. 9, 1998

[51] Int. Cl.[6] ..... B02C 18/38

[52] U.S. Cl. ..... 241/82.5

[58] Field of Search ..... 241/82.1–82.7

[56] References Cited

U.S. PATENT DOCUMENTS

| | | | |
|---|---|---|---|
| 2,531,158 | 11/1950 | Robinson | 241/82.1 |
| 3,310,086 | 3/1967 | Lasar | 241/82.1 |
| 4,736,896 | 4/1988 | Wagner | 241/82.1 |
| 5,872,413 | 2/1999 | Magliari | 241/82.1 |

FOREIGN PATENT DOCUMENTS

| | | | |
|---|---|---|---|
| 815383 | 10/1951 | Germany | 241/82.1 |
| 1094943 | 12/1960 | Germany | 241/82.1 |

*Primary Examiner*—Mark Rosenbaum
*Attorney, Agent, or Firm*—Charles E. Baxley, Esq.

[57] ABSTRACT

A mincer device includes a housing having an orifice for rotatably receiving a shaft and a barrel which is secured to the shaft and which has an engaging hole. A Rotor is coupled to the shaft for rotating the shaft and the barrel. A casing has a chamber for rotatably receiving a screw and has one end for engaging into the housing and includes a chute extended upward for receiving a seat to be minced. The screw has an engaging end for engaging with the barrel and for allowing the screw to be driven by the shaft. The mincer device may include one or more casings of different screws for allowing the user to easily change the casings of different screws.

4 Claims, 7 Drawing Sheets

MEAT MINCER COMBINATION HAVING A MINCER DEVICE REPLACEABLE STRUCTURE

BACKGROUND OF THE INVENTION

1. Field of the Invention

The present invention relates to a seat mincer, and more particularly to a seat mincer combination having one or more mincer devices that may be easily selected and attached to the mincer body according to the user's need.

2. Description of the Prior Art

Typical seat mincers comprise a mincer body having a screw rotated by a motor in order to since the meat. However, the screw or the mincer device may not be selected and replaced with another one.

The present invention has arisen to mitigate and/or obviate the afore-described disadvantages of the conventional seat mincers.

SUMMARY OF THE INVENTION

The primary objective of the present invention is to provide a meat mincer combination including one or more mincer devices that may be easily selected and attached to the mincer body according to the user's need.

In accordance with one aspect of the invention, there is provided a mincer combination comprising a housing including an orifice formed therein, a shaft rotatably received in the orifice of the housing, a barrel rotatably received in the orifice of the housing and including a first end secured to the shaft and rotated in concert with the shaft and including a second end having an engaging hole formed therein, means for rotating the shaft and the barrel, a casing including a chamber formed therein and including a first end having a sleeve for engaging into the orifice of the housing, the casing including a chute extended upward for receiving a neat to be minced, means for positioning the casing to the housing, and a screw rotatably received in the chamber of the casing for mincing the neat and including an engaging end extended outward of the casing for engaging with the engaging hole of the barrel and for allowing the screw to be driven by the shaft when the sleeve of the casing is engaged into the orifice of the housing. The casing is allowed to be disengaged from the housing and the sleeve of the casing is allowed to be engaged into the orifice of the housing for engaging the engaging end of the screw with the engaging hole of the barrel.

The shaft includes a worm secured thereon and rotated in concert with the shaft, the shaft rotating means includea a motor secured in the housing and having a spindle and a worm gear secured on the spindle and engaged with the worm of the shaft for driving the shaft via the worm gear and the worm.

A duct is further engaged in the orifice of the housing and secured to the housing, the duct includes an aperture formed therein, the casing positioning means includes a pin extended from the casing for engaging with the aperture of the duct and for positioning the casing to the duct.

The screw includes an outer end, the mincer combination further includes a rod secured to the outer end of the screw, a cutter device secured on the rod and rotated in concert with the screw, and a disc engaged on the rod and having a plurality of punctures formed therein for allowing the neat to be moved outward of the casing. The casing includes a cap secured thereon and engaged with the disc for retaining the disc and the screw in place.

The casing includes a chute extended upward, and a pan having a tubular member extended downward for engaging into the chute and for securing to the casing. The tubular member includes an outward expanding end secured to the pan for reinforcing the pan.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 4:
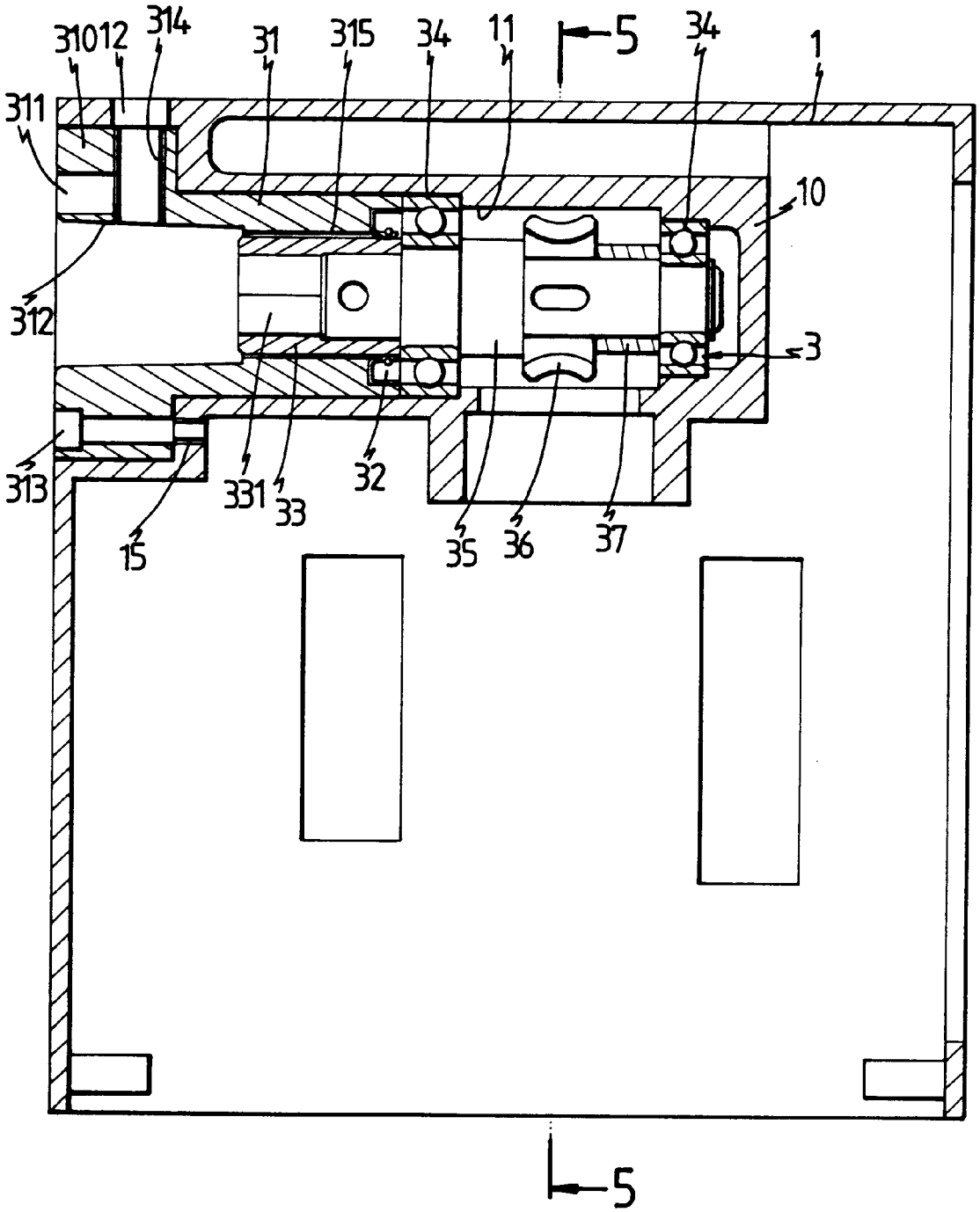
FIG. 4 is a cross sectional view taken along lines 4—4 of FIG. 5.

Referring to the drawings, and initially to FIGS. 1–4, a meat mincer combination in accordance with the present invention comprises a housing 1 including an orifice 11 (FIGS. 2, 4) formed in the upper portion and defined by a tubular member 10. A shaft 35 is rotatably received in the orifice 11 of the housing 1 by bearings 34 and includes a worm 36 secured thereon by a key 39, such that the worm 36 and the shaft 35 rotate in concert with each other. A spacer 37 is engaged between the bearing 34 and the worm 36 for positioning the worm 36 in place. A duct 31 is received in the open end of the orifice 11 of the housing 1 and includes an enlarged head 310 having one or more holes 313 for receiving fasteners 38 which are threaded with the screw holes 15 of the housing 1 for securing the duct 31 to the housing 1. Another fastener 17 is further engaged through a hole 12 of the housing 1 and threaded with a screw hole 314 of the duct 31 for further solidly securing the duct 31 to the housing 1. The head 310 of the duct 31 includes an aperture 311 facing outward of the housing 1 (FIG. 4). The duct 31 includes a bore 315 having a front portion 312 of a greater size and of a size gradually reduced from the outer end to the inner end. A barrel 33 is rotatably received in the bore 315 of the duct 31 and secured to one end of the shaft 35 by such as a key or by fasteners, for allowing the barrel 33 and the shaft 35 to be rotated in concert with each other. The barrel 33 includes a non-circular engaging hole 331 formed in the outer portion. A sealing ring 32 is preferably engaged between the barrel 33 and the bearing 34 for preventing the oil or the grease from entering into the bearing 34. The housing 1 includes a handle 16 for carrying purposes.

Figure 1:
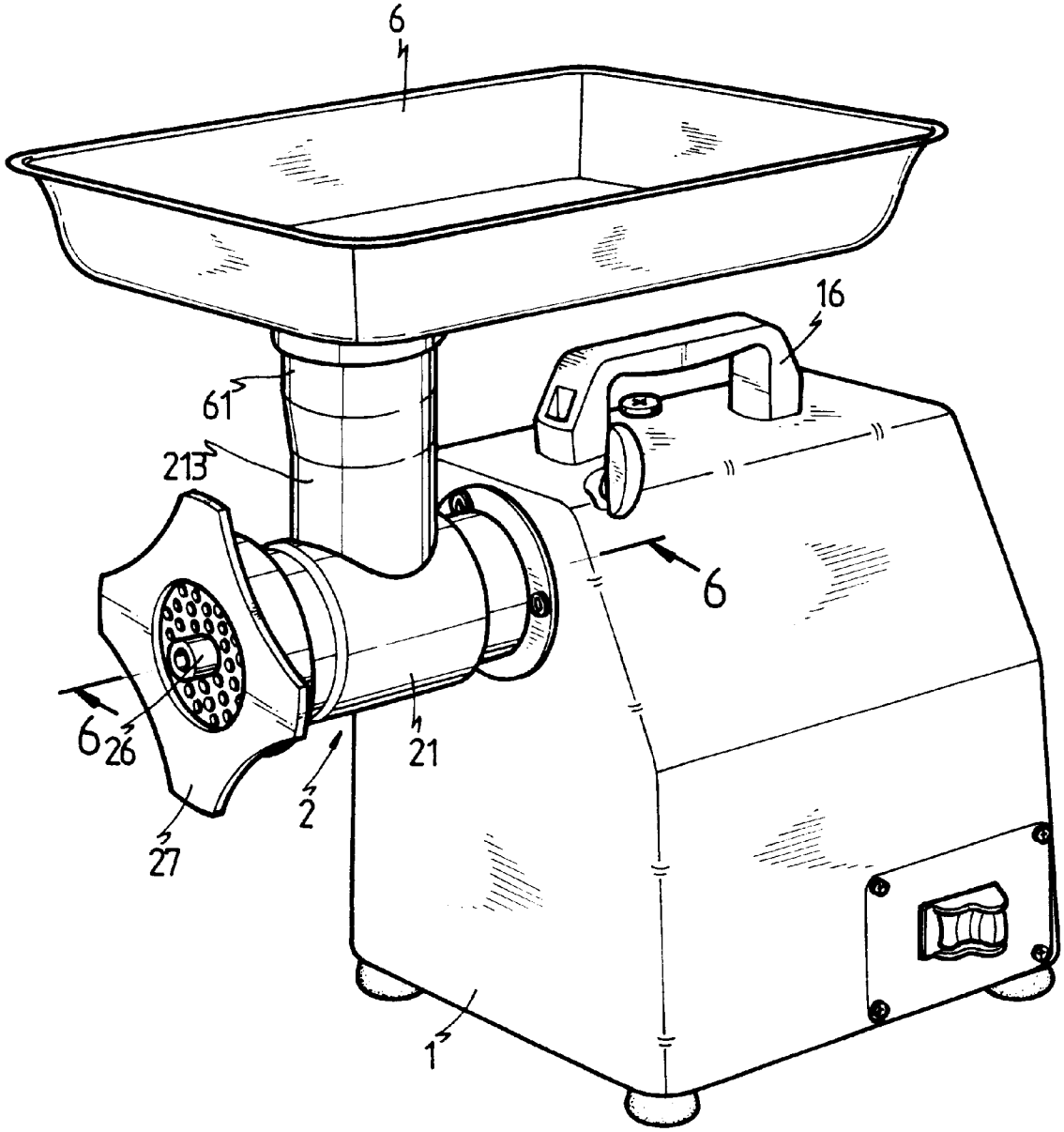
FIG. 1 is a perspective view of a meat mincer combination in accordance with the present invention.
Figure 2:
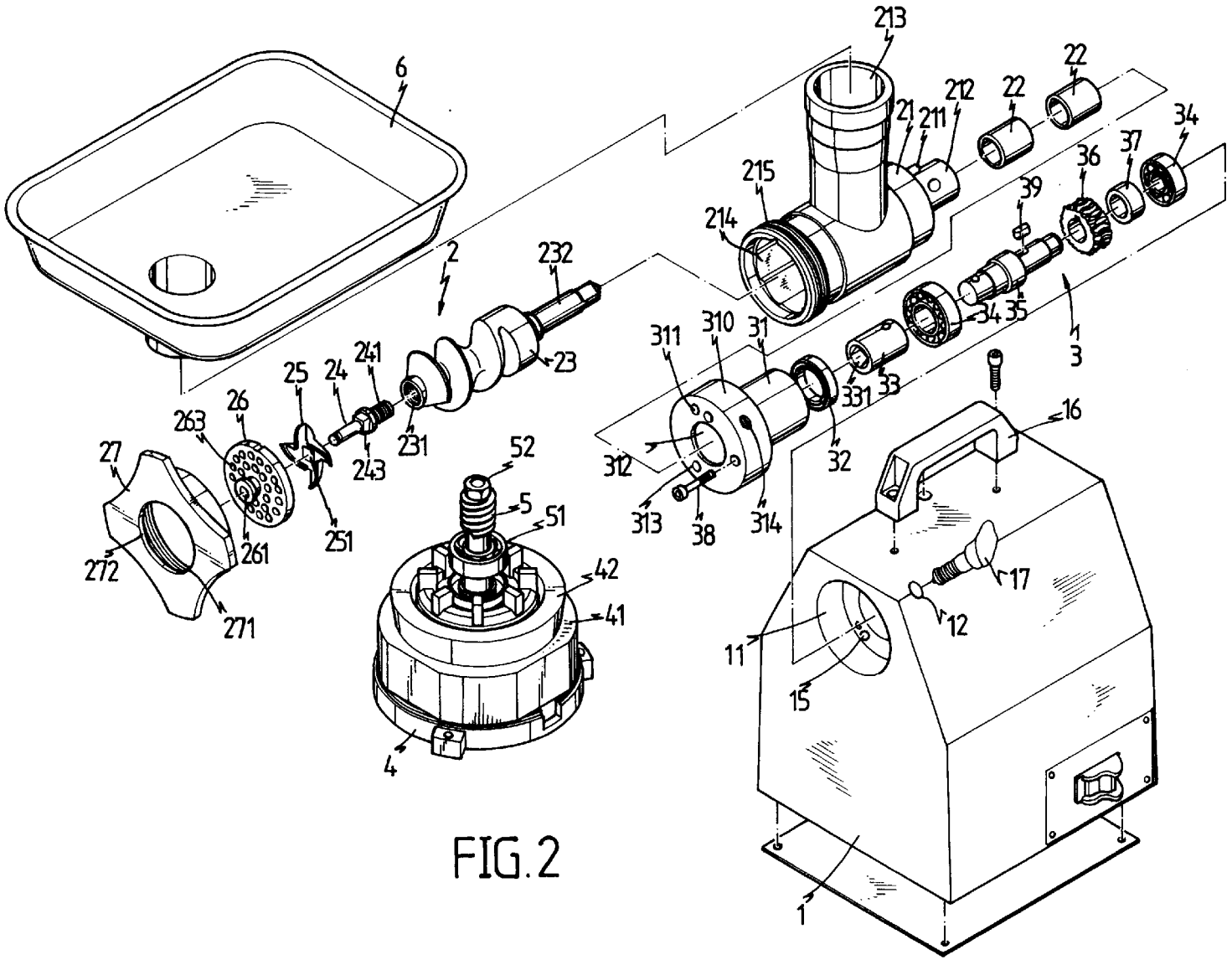
FIG. 2 is an exploded view of the meat mincer combination.
Figure 3:
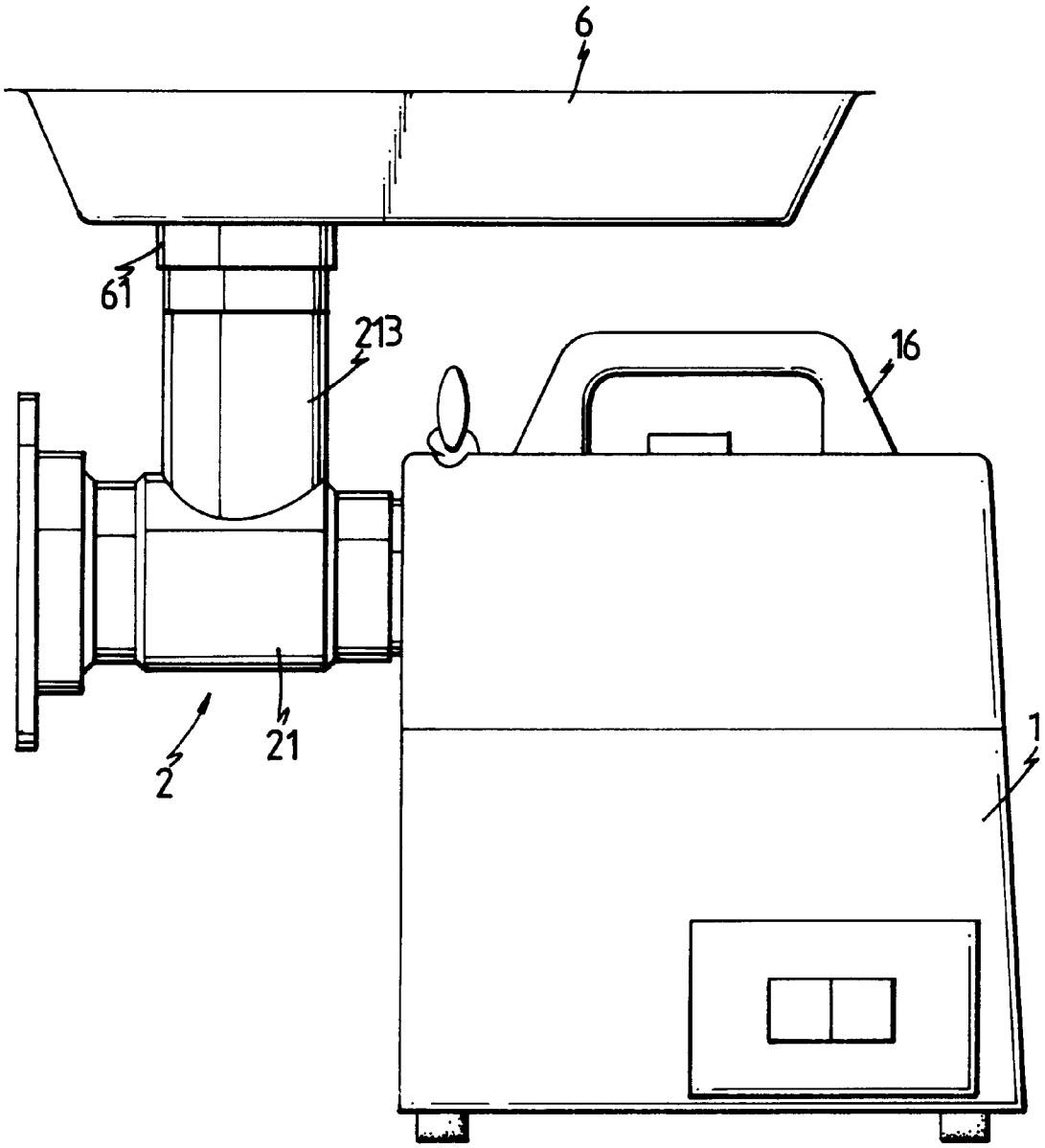
FIG. 3 is a front view of the meat mincer combination.
Figure 5:
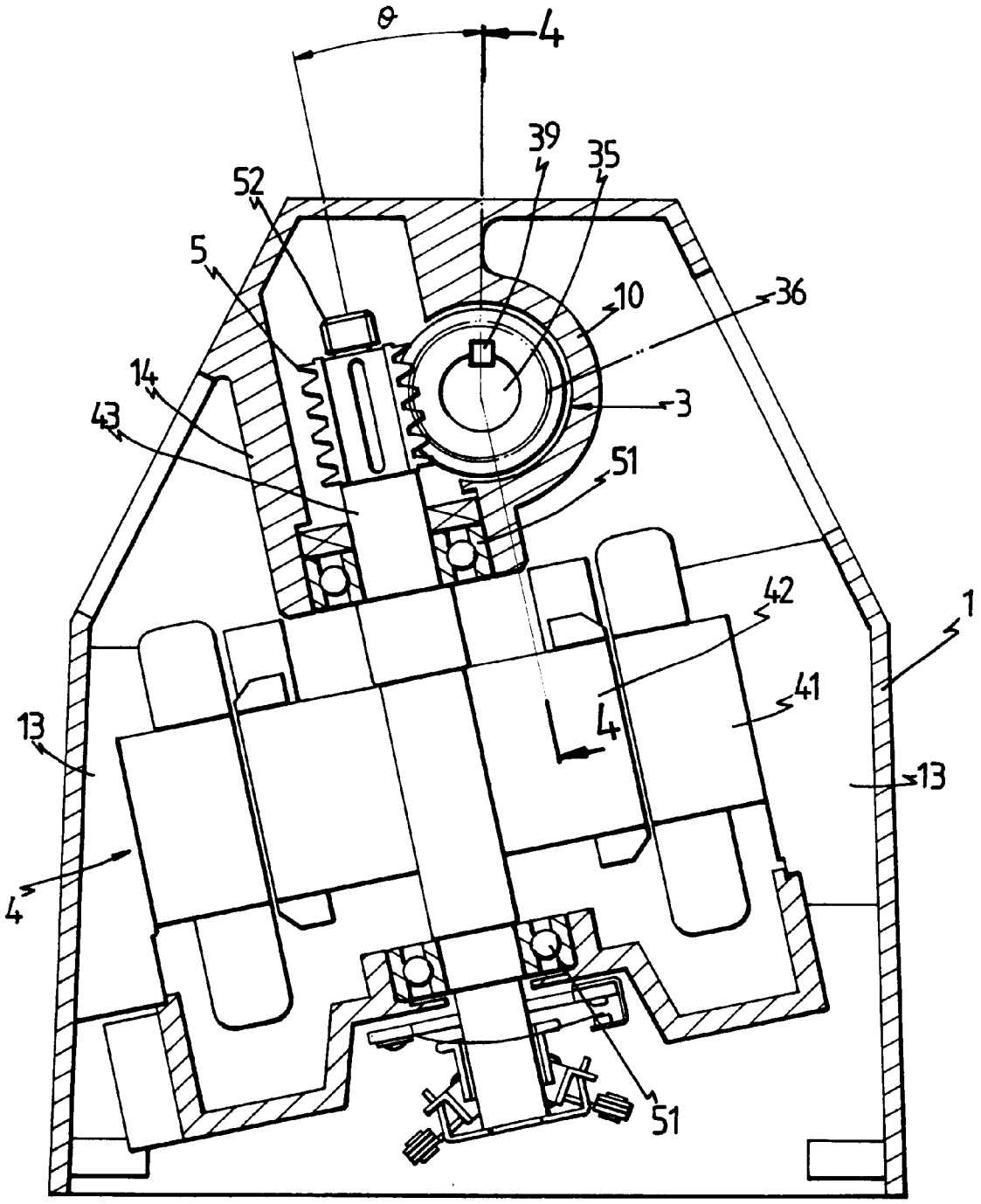
FIG. 5 is a cross sectional view taken along lines 5—5 of FIG. 4.

Referring next to FIG. 5 and again to FIG. 2, a motor 4 includes a stator 41 secured between a base 13 and a support 14 of the housing 1 and includes a rotor 42 rotatably received in the stator 41 and includes a spindle 43 secured to the rotor 42 and rotatably secured in the housing 1 by bearings 51. A worm gear 5 is secured on the spindle 43 by a fastener 52 so as to be rotated by the motor 4. The worm gear 5 is engaged with the worm 36 of the shaft 35 such that the shaft 35 and the barrel 33 may be rotated by the motor 4. An included angle a (FIG. 5) between the longitudinal axis of the spindle 43 and the vertical axis is about 12 degrees, but may be changed according to the types and the sizes of the worm 36 and of the worm gear 5.

Referring next to FIG. 6 and again to FIG. 2, a mincer device 2 includes a casing 21 having a chamber 214 formed therein for rotatably receiving a screw 23 and having a sleeve 212 extended from one end thereof for rotatably receiving the one end of the screw 23 by bushings 22. The sleeve 212 may be engaged into the front portion of the bore 315 of the duct 31 by such as a force-fitted engagement. The casing 21 includes a pin 211 extended therefrom for engaging with the aperture 311 of the duct 31 and for positioning the casing 21 to the housing 1. The screw 23 includes an engaging end 232 having a non-circular cross section corresponding to that of the engaging hole 331 of the barrel 33 for allowing the screw 23 to be driven by the motor 4 via the shaft 35 and the barrel 33. The casing 21 includes a chute 213 extended upward for securing a pan 6 and for receiving the meat to be minced.

Figure 7:
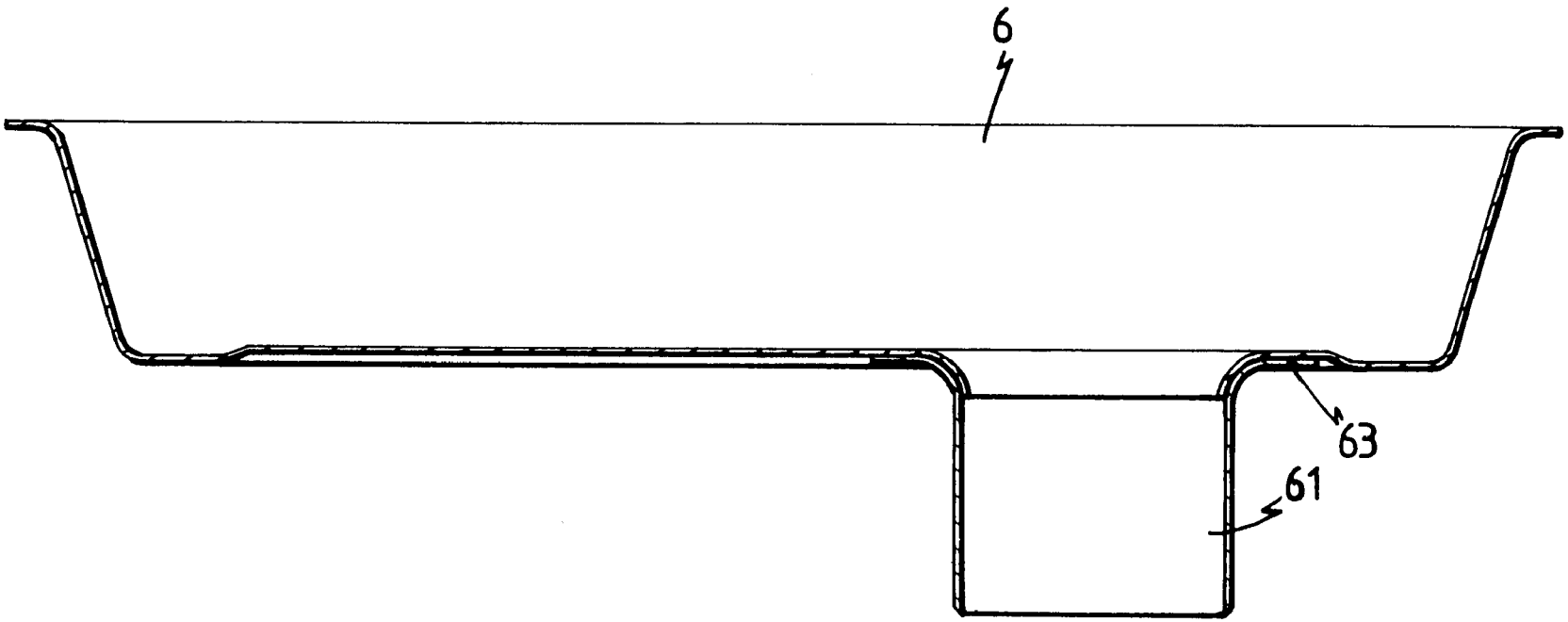
FIG. 7 is a cross sectional view of the pan.

A tubular member 61 (FIG. 7) has an outward expanding end 63 for securing to the pan 6 by such as a welding process and for reinforcing the pan 6 and has a lower portion for engaging into the chute 213 of the casing 21. The screw 23 includes an inner thread 231 foremd in the other end for threadedly engaging with a bolt 241 of a rod 24. A cutter device 25 includes a non-circular hole 251 for engaging with a non-circular portion 243 of the rod 24 such that the cutter device 25 may also be rotated by the motor 4 via the screw 23. A disc 26 includes a bore 261 engaged on the rod 24 and includes a number of punctures 263 for allowing the cut and minced meat to be moved outward of the casing 21. A cap 27 includes an inner thread 271 for engaging with an outer thread 215 of the casing 21 and includes an annular flange 272 extended radially inward for engaging with the disc 26 and for retaining the disc 26 and the cutter device 25 and the screw 23 in place. It is preferable that a distance between the pan 6 and the screw 23 is more than 10 cm for preventing the hand of the user from being easily damaged by the screw 23.

Figure 6:
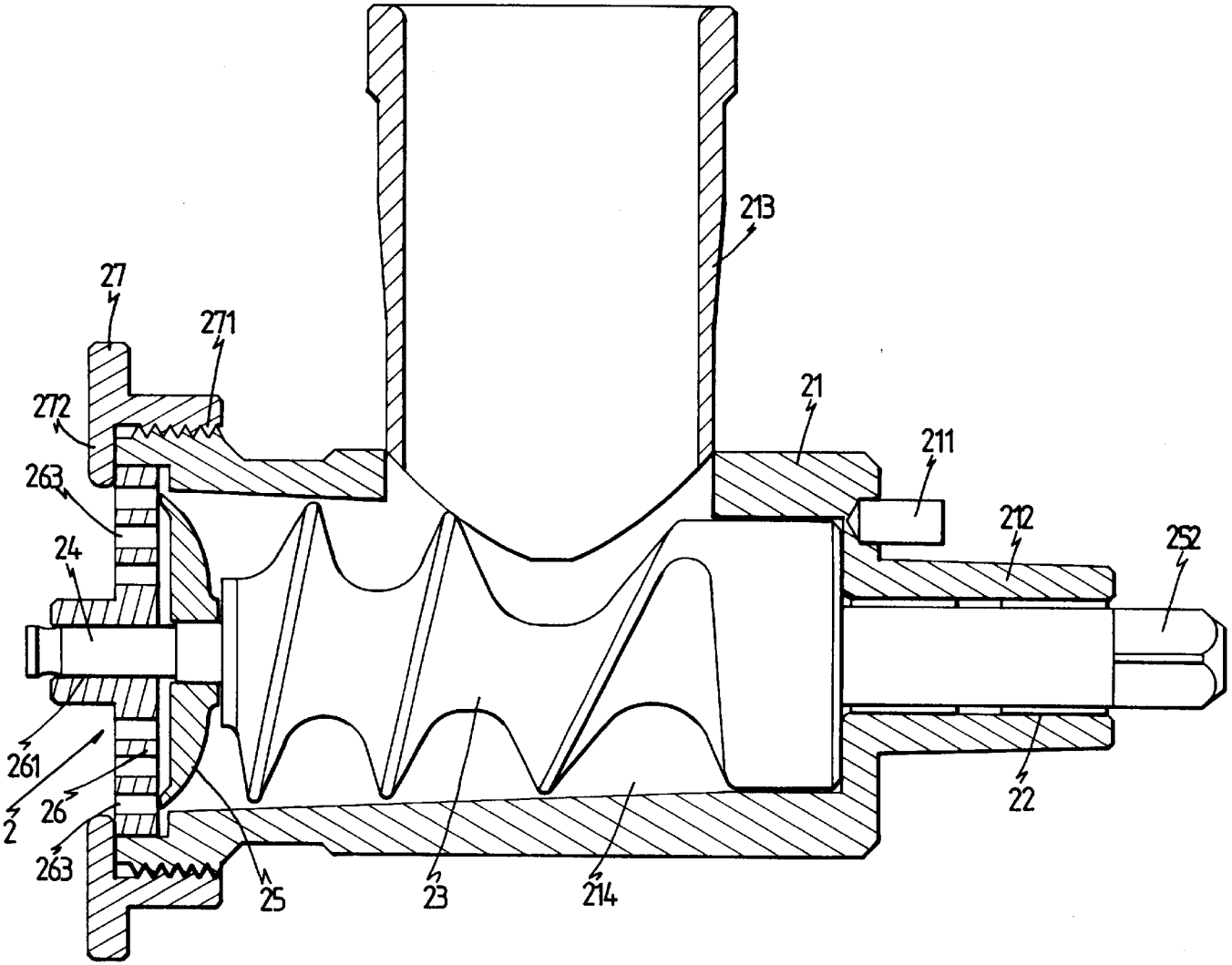
FIG. 6 is a cross sectional view taken along lines 6—6 of FIG. 1.

In operation, the sleeve 212 of the mincer device 2 as shown in FIG. 6 may be easily engaged into the front portion of the bore 315 of the duct 31, and the pin 211 of the casing 21 may be easily engaged with the aperture 311 of the duct 31 for positioning the casing 21 to the housing 1. The engaging end 232 of the screw 23 may be easily engaged into the engaging hole 331 of the barrel 33 for allowing the screw 23 to be driven by the motor 4 via the shaft 35 and the barrel 33. The mincer device may prepare one or more types of the mincer devices 2. For example, the mincer devices 2 may include different screws 23 or different cutter device 25 or different discs 26, for allowing the user to select the required ones and for allowing the user to easily replace and engage the required one to the housing 1.

Accordingly, the meat mincer combination in accordance with the present invention includes one or more mincer devices that may be easily selected and attached to the mincer body according to the user's need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mincer combination comprising:

a housing including an orifice formed therein, a shaft rotatably received in said orifice of said housing, a barrel rotatably received in said orifice of said housing and including a first end secured to said shaft and rotated in concert with said shaft and including a second end having an engaging hole formed therein, means for rotating said shaft and said barrel, a duct engaged in said orifice of said housing and secured to said housing, said duct including a bore and an aperture formed therein, a casing including a chamber formed therein and including a first end having a sleeve for engaging into said bore of said duct, said casing including a chute extended upward for receiving a meat to be minced, said casing including a pin extended therefrom for engaging with said aperture of said duct and for positioning said casing to said duct, and a screw rotatably received in said chamber of said casing for mincing the meat and including an engaging end extended outward of said casing for engaging with said engaging hole of said barrel and for allowing said screw to be driven by said shaft when said sleeve of said casing is engaged into said orifice of said housing, said casing being allowed to be disengaged from said housing and said sleeve of said casing being allowed to be engaged into said orifice of said housing for engaging said engaging end of said screw with said engaging hole of said barrel.

2. The mincer combination as claimed in claim 1, wherein said shaft includes a worm secured thereon and rotated in concert with said shaft, said shaft rotating means includea a motor secured in said housing and having a spindle and a worm gear secured on said spindle and engaged with said worm of said shaft for driving said shaft via said worm gear and said worm.

3. The mincer combination as claimed in claim 1, wherein said screw includes an outer end, said mincer combination further includes a rod secured to said outer end of said screw, a cutter device secured on said rod and rotated in concert with said screw, and a disc engaged on said rod and having a plurality of punctures formed therein for allowing the meat to be moved outward of said casing.

4. The mincer combination as claimed in claim 3, wherein said casing includes a cap secured thereon and engaged with said disc for retaining said disc and said screw in place.

* * * * *